United States Patent [19]

Moisan

[11] Patent Number: 4,852,855

[45] Date of Patent: Aug. 1, 1989

[54] MANEUVERING DEVICE FOR HEAVY FLAT PLATES

[76] Inventor: Gerald L. Moisan, 12555 North 75th St., Longmont, Colo. 80501

[21] Appl. No.: 156,380

[22] Filed: Feb. 16, 1988

Related U.S. Application Data

[63] Continuation-in-part of Ser. No. 93,857, Sep. 8, 1987, abandoned.

[51] Int. Cl.[4] ..... B66F 11/00

[52] U.S. Cl. ..... 254/131

[58] Field of Search ..... 254/120–123, 254/131, 131.5; 294/15, 17, 91; 414/444, 457; 280/47.27

[56] References Cited

U.S. PATENT DOCUMENTS

| | | | |
|---|---|---|---|
| 1,714,401 | 5/1929 | Sigsbee . | |
| 2,655,399 | 10/1953 | McMillan | 294/17 |
| 2,980,200 | 4/1961 | Kibby | 182/16 |
| 3,091,983 | 6/1963 | Kliss | 81/15 |
| 3,198,362 | 8/1965 | Berg | 214/370 |
| 3,257,018 | 6/1966 | Miles | 214/370 |
| 3,275,299 | 10/1966 | Meshew | 254/131 |
| 3,837,622 | 10/1974 | Gale | 254/131 |
| 4,126,297 | 11/1978 | Barnes | 254/131 |
| 4,157,810 | 6/1979 | Haller et al. | 254/131 |
| 4,365,925 | 12/1982 | Girtz | 414/684.3 |
| 4,482,182 | 11/1984 | Mortensen | 294/15 |
| 4,488,706 | 12/1984 | Kono | 254/131 |
| 4,577,897 | 3/1986 | Mazac | 294/15 |
| 4,653,728 | 3/1987 | Mochizuki et al. | 254/131 |
| 4,662,607 | 5/1987 | Mochizuki et al. | 254/131 |

*Primary Examiner*—Judy Hartman

*Attorney, Agent, or Firm*—Earl C. Hancock; Francis A. Sirr

[57] ABSTRACT

Large, flat objects such as manhole covers, storm drain grates and the like, are lifted and maneuvered. A tool includes a gripper assembly which receives the object at or near an edge and establishes control by an arrangement of at least one concentrated contact area or pressure point on one surface of the object and a pair of such concentrated contact areas or pressure points on the other surface. A long lever handle allows pivoting to raise the object; rollers on the tool accommodate maneuvering afterwards. Avoidance of runaway rolling and maintenance of positive movement control is possible by a stub or pin which is attachable is desired to engage the ground, street or the like, after the object is lifted.

8 Claims, 3 Drawing Sheets

FIG. 9.
FIG. 10.
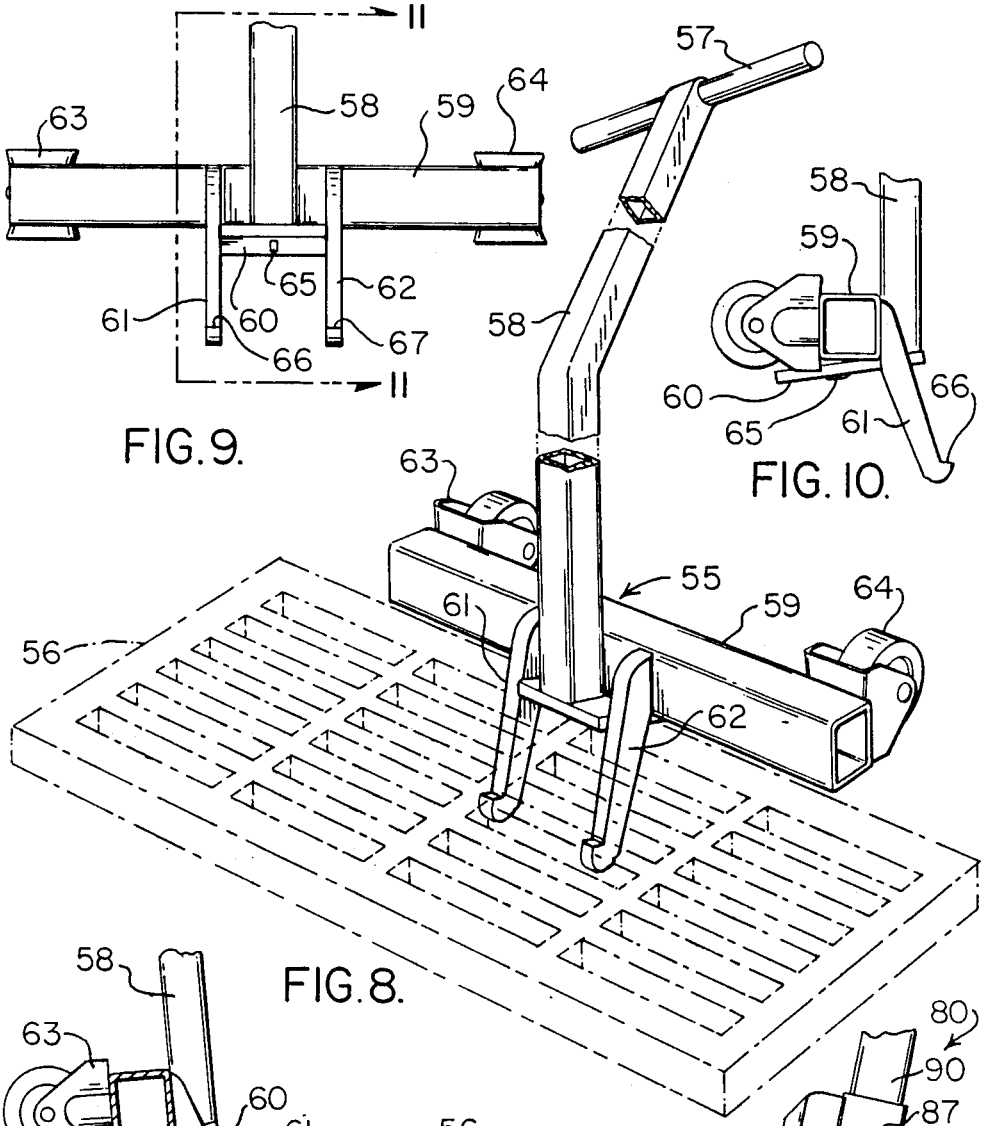
FIG. 8.
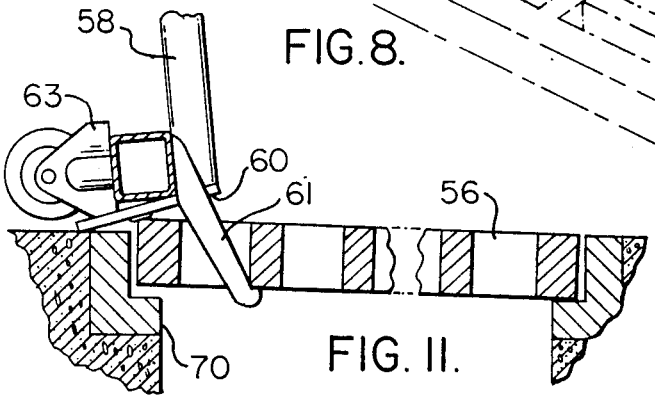
FIG. 11.
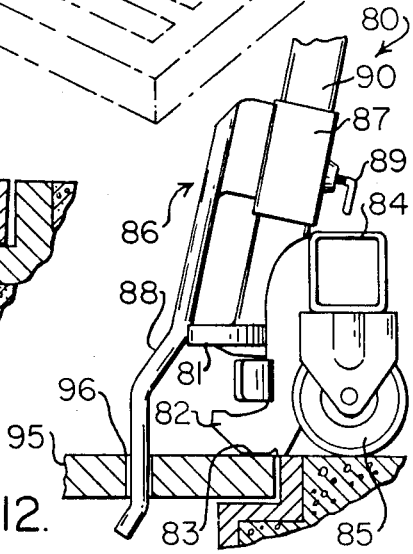
FIG. 12.

MANEUVERING DEVICE FOR HEAVY FLAT PLATES

This is a continuation-in-part of application Ser. No. 093,857, filed Sep. 8, 1987, now abandoned.

TECHNICAL FIELD

The present invention relates to tools and means for handling heavy flat plates. More particularly, this invention relates to apparatus and methods for lifting heavy flat plates and thereafter maneuvering such plates from one location to another. The invention is useful for lifting, removing, relocating, and replacing disk shaped objects and open grid grates; it is especially well suited for performing such functions on manhole covers and on grates for protecting storm drains in a safe and convenient manner.

BACKGROUND

Lifting and moving large flat plates such as manhole covers is not only physically difficult but also hazards the risk of injury to those involved. A typical manhole cover is two to three feet in diameter, about one inch thick and, more importantly, weighs between 180 and 360 pounds. Open grid storm drain grates are of similar thickness and weight although usually rectangular in shape. This awkward size and weight has caused many a serious injury when only a pinch or pry bar produced by manual labor. An example of an improved pry bar intended to ease the initial lifting is shown in U.S. Pat. No. 3,837,622 by Gale.

A variety of configurations have received attention over the years to simplify plate handling. Some require special adaptation of the cover to match the tool such as the edge groove and tool hook arrangement of U.S. Pat. No. 4,482,182 by Mortensen and the threaded engagement devices of U.S. Pat. Nos. 3,198,362 by Berg, 4,157,810 by Haller et al, and 4,365,925 by Girtz. Such devices are useless for covers not modified to mate the engaging structure. In addition, dirt and debris from normal usage of the covers impedes use of the device even if the cover is suitably modified.

Others have suggested use of L-shaped arms for insertion into holes in the covers which are then forced or pivoted under the lower surface of the plate for lifting. Examples are shown in U.S. Pat. Nos. 4,126,297 by Barnes, 4,488,706 by Kono, 4,653,728 by Mochizuki et al and 4,662,607 by Mochizuki et al. The necessarily small size of the transverse lip of the L-shaped member along with hazards from wear of that lip from use seriously discount these devices as adequate solutions. In addition, they too suffer from problems of debris plugging the holes and, of course, are useless for covers that have no holes. U.S. Pat. No. 3,275,299 by Meshew, although another version of the L-shaped arm approach, additionally suggests configuring a lower ground engaging cam surface to aid in raising the cover after it is engaged.

A wide tongue for sliding under a dockboard and opposed parallel surfaces formed by inverted L-shaped cutaway stops is shown in U.S. Pat. No. 3,257,018 by Miles. While the Miles type device may represent a reasonably acceptable transporter for wide plates like dockboards, it is not an acceptable configuration for use with manhole covers and the like wherein the edge available for gripping is constrained in width. That is, use of a Miles type hand truck for moving manhole covers is extremely hazardous as the cover tends to slide laterally against the flat, parallel upper and lower surfaces of the tongue and cutaway stops.

DISCLOSURE OF THE INVENTION

The present invention is a relatively simple device for safely gripping the edges of large, heavy plates to allow relatively easy lifting and maneuvering of such plates. This result is achieved with significant reduction of risk of physical injury to the users either from physical strain which frequently causes back injuries and/or from loss of control of the cover once it is removed from the manhole with its attendant threat of injury to the user's fingers and feet, for instance.

The invention in one form is configured with a gripper assembly that includes at least one pair of plate means which are rigidly attached to a frame so as to extend outwardly from that frame in spaced but generally parallel relation to one another. These plate areas are arranged so that, when the flat object is inserted between them (IE: occupies the space between the planes defined by those plates), one of the plate means engages a surface of the object in one concentrated contact or pressure point area while the other plate means engages the opposite object surface in at least two concentrated contact or pressure point areas, these latter two pressure point areas occurring on opposite sides relative to the first mentioned pressure point area. Another means such as an extended handle allows pivoting of the assembly in a direction generally perpendicular to one of the object surfaces and a roller means associated with the gripper assembly allows movement of the device, first to receive the object and subsequently for transporting it after the assembly is upwardly pivoted.

When configured as a manhole manipulator, the aforementioned plates are positioned in a generally overlying relation. This accommodates direct receipt of the manhole between them. For open grid grate manipulation, the plate means are positioned in an offset relation. This allows insertion of the device into a grid opening in proximity to the grate edge thereby engaging the grate surfaces on opposite sides of the grid opening.

In one form, the pressure point area first mentioned above is established by a ramp sloping outwardly from the frame and in position to overlie the upper surface of the object.

Yet another form of the invention is particularly adapted for use with flat plates such as grates or manhole covers which have one or more holes extending therethrough. In this embodiment, a gripper assembly is employed which includes a frame member, a rod and at least two arms with the rod and arms attached to the frame member but extending therefrom in a first direction. An elongated handle is likewise attached to the frame member but extends in a direction opposite the first direction. The rod is adapted to fit through the plate hole to establish a pressure contact point in proximity to the lower plate surface while the two arms establish spaced contact points on the opposite plate surface. This allows rotation of the gripper assembly so that the plate is securely lifted and retained.

The invention is suitable for advantageous adaptation to include a stub means on one extremity of the frame so that it engages the ground after the assembly is pivoted so as to accommodate arcuate movement of the apparatus around the roller wheel on the other extremity of the frame. The stub is positionable so that the roller wheel associated with the end of the frame to which the stub is attached engages the ground instead of the stub when the frame is only partially pivoted.

The use of the stub is particularly attractive when it is necessary to remove a manhole cover or grate at a location where there is a high risk of loss of control of the cover at a time that maintenance of such control is critical such as on a sloping street or hillside.

Those having normal skill in the art will recognize the foregoing and other objects, features, advantages and applications of the present invention from the following more detailed descriptions of the preferred embodiments as illustrated in the accompanying drawings.

BRIEF DESCRIPTION OF THE DRAWINGS

FIG. 8 is an isometric view of another embodiment of the invention for handling open grid grates.

FIG. 9 is a front view of the FIG. 8 embodiment.

FIG. 10 is a side view of the FIG. 8 apparatus.

FIG. 11 is a section view taken along line 11-11 of FIG. 9 and showing the cooperation of the device and a grate in initially breaking the grate loose before lifting it.

FIG. 12 is a side view of an embodiment including an attachment for providing a carrying handle as well as means for lifting flat plates which have holes extending therethrough.

DETAILED DESCRIPTION OF THE PREFERRED EMBODIMENTS

Figure 1:
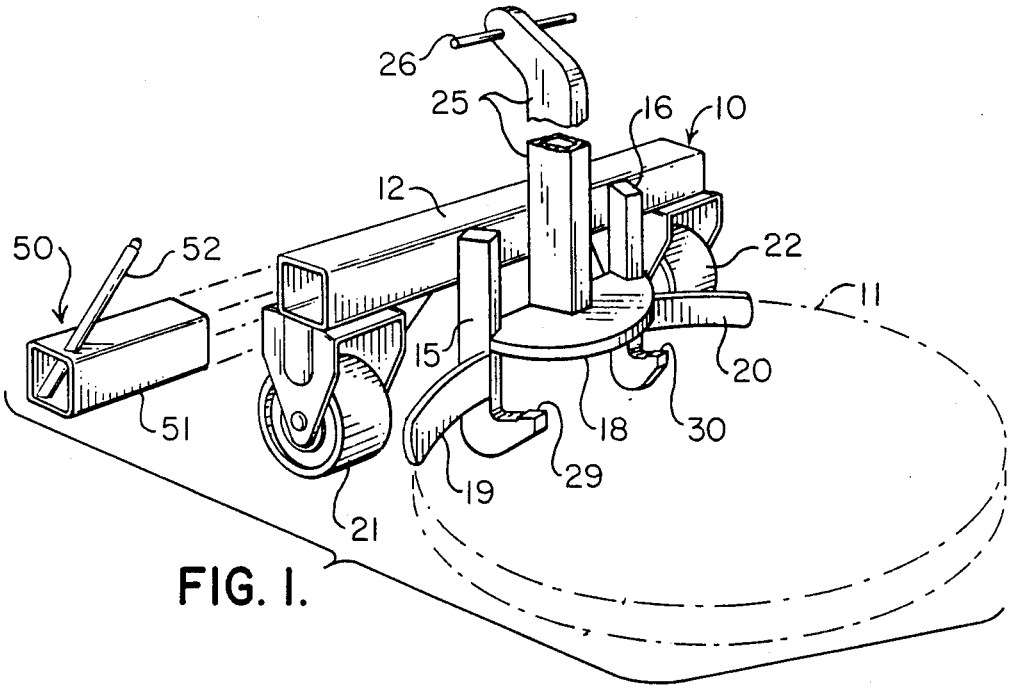
FIG. 1 is an isometric view of an embodiment of the invention and additionally illustrates the inoperative or storage relationship of a stub member with respect to the apparatus.

The plate lifting and maneuvering device 10 of this invention is shown in perspective in FIG. 1 in relation to a large round object 11 shown in phantom. The present invention is particularly well suited for use when object 11 is a contemporary manhole cover which typically is about two, two and one-half or three feet in diameter and weighing 180 to 360 pounds or more. Auxiliary attachment 50 is also illustrated in FIG. 1 in its inoperative storage position relative to tool 10. However, assembly 50 is not an essential element of tool 10 and is described in more detail later in conjunction with FIGS. 5, 6 and 7.

A gripper assembly is configured by tubular frame 12 to which J-shaped side bars 15 and 16 are rigidly attached. A semicircular plate 18 extends outwardly from side bars 15 and 16 generally parallel to the lower, plate-like surfaces of the transverse projections of side bars 15 and 16. An elongated column 25 is secured to plate 18 and frame 12 with a T-handle 26 at its upper end for convenience.

Figure 2:
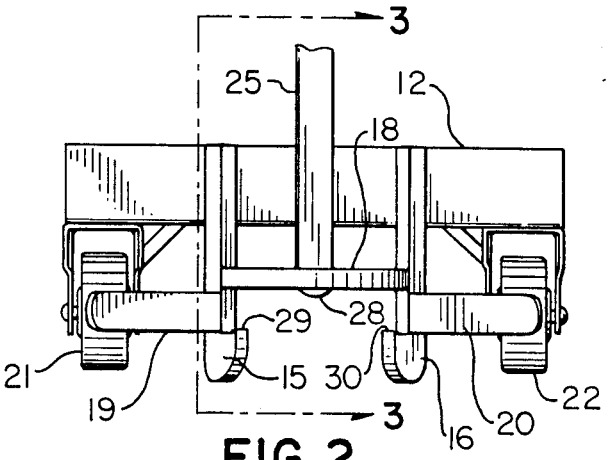
FIG. 2 is a front view of the FIG. 1 apparatus.
Figure 3:
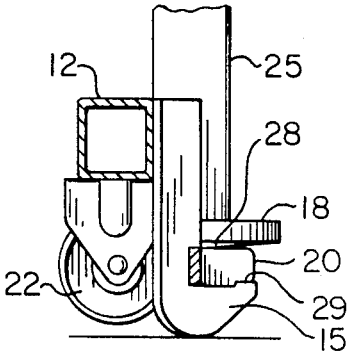
FIG. 3 is a partially sectioned view of the FIG. 1 apparatus.
Figure 4:
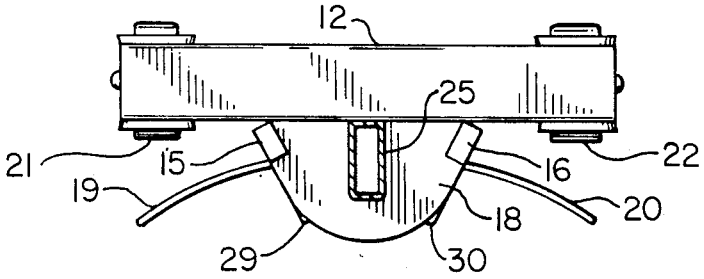
FIG. 4 is a top, partially sectioned view of the FIG. 1 apparatus.

FIGS. 2 and 3 best show the ramp projection 28 on the lower surface of plate 18 and the upwardly directed nubs 29 and 30 on side bars 15 and 16, respectively. The ability of tool 10 to grip and securely retain manhole cover 11 is obtained by the concentrated contact in relatively small pressure point areas established by engagement of the upper surface of cover 11 by ramp 28 and the engagement of the lower surface by nubs 29 and 30. That is, introduction of cover 11 between plate 18 and the lower projections of bars 15 and 16 along with lifting by pulling back on lever handle 25 so as to pivot the gripper assembly perpendicular to the general plane of cover 11 causes the full weight of cover 11 to concentrate at the relatively small contact areas associated with ramp 28 and nubs 29 and 30. Thus any tendency of cover 11 to slip or slide as tool 10 is rolled on wheels 21 and 22 is significantly reduced or eliminated.

An arrangement to further secure cover 11 within the gripper assembly is the outwardly extending wings 19 and 20. Note that these wings are not essential to the safe and successful operation of tool 10 when the aforementioned concentrated contact areas are properly located. Wings 19 and 20 assist when tool 10 is rolling with cover 11 in the gripper assembly to further ensure against side slip of cover 11. They are preferably configured to conform to the larger manhole cover diameters tool 10 is likely to encounter. However, tool 10 was successfully employed for the full range of usual manhole cover diameters by using wings 19 and 20 set for a median diameter of covers 11. Of course, wings 19 and 20 can be made adjustable if desired.

In operation, cover 11 is pried up by inserting a conventional pry tool under its lip. Tool 10 is then rolled into position and slid under the lower surface of cover 11 so as to receive it between plate 18 and the outward extensions on the lower ends of bars 15 and 16. Note that tool 10 can slide somewhat on the bottom, rounded edges of bars 15 and 16 which also provide a cam function. The user pulls backwardly on lever handle 25 so that cover 11 is pivoted upwardly out of the manhole. Cover 11 is then conveniently and safely rolled out of the way and stored until such time as it is appropriate to replace cover 11 on the manhole.

Some circumstances may dictate minimization of the amount of rolling of tool 10 after cover 11 is retained within the gripper assembly. One example is where the manhole is in a street that is sloping. With the cover 11 lifted and tool 10 pivoted back onto wheels 21 and 22, the slope of the street may make it difficult to maintain control of tool 10. Accordingly, attachment 50 is useful to facilitate control whenever it is desired to minimize the amount of rolling of tool 10 with cover 11.

As seen in FIG. 1, attachment 50 is formed of a box channel frame member 51 of a square cross section. Frame 51 is dimensioned so as to fit into either of the hollow ends of box channel frame 12 of tool 10. Rigidly attached to one end of frame 51 is a pivot pin or stub 52. When frame 51 is inserted into either of the ends of member 12 with stub 52 pointing upwardly as illustrated in FIG. 1, attachment 50 is essentially stored in an inoperative position and has no impact on use of tool 10 along the lines as described above. Of course other arrangements of storage for member 50 are possible but the configuration shown has the advantage of requiring no additional components or modifications of tool 10.

Figure 5:
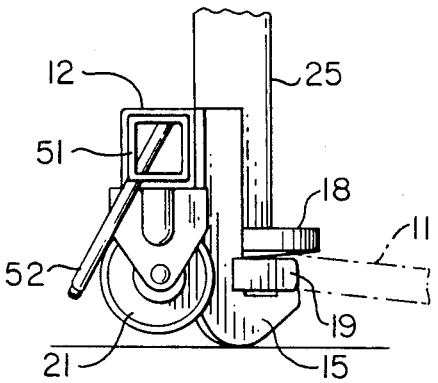
FIG. 5 is a side view showing adaptation of the FIG. 1 apparatus for inclusion of a stub member in operative attachment thereto.
Figure 6:
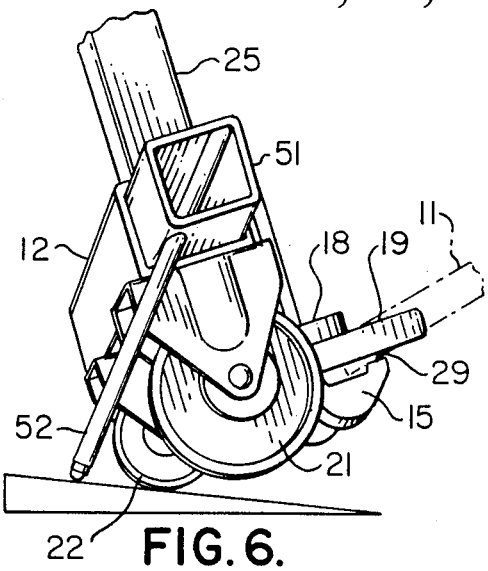
FIG. 6 is a view similar to FIG. 5 except showing the stub member in its position for arcuate movement of the apparatus.
Figure 7:
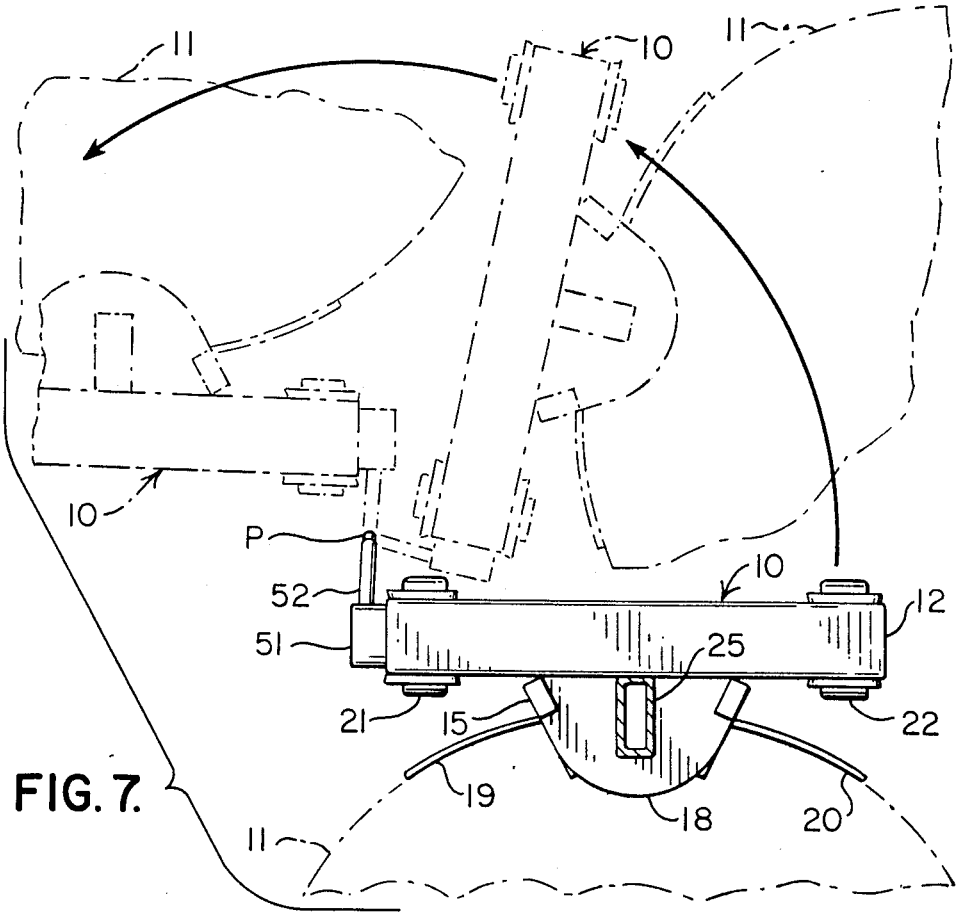
FIG. 7 is a top view showing the arcuate movement when the stub member is oriented as in FIG. 6.

For operative use of attachment 50, it is withdrawn from frame 12, rotated and reinserted into an appropriate one of the open ends of box channel frame 12 in the orientation shown in FIG. 5. Pin 52 is so located that it does not touch the ground or impede rolling of tool 10 on its wheels 21 and 22 when tool 10 is in a generally upright position. This accommodates positioning of tool 10 to receive cover 11 in the same manner as aforesaid. However, once cover 11 is received between the two gripper assembly plates, pulling backwards on lever handle 25 results in stub pin 52 engaging the ground and causing wheel 21 to lift out of rolling position as is shown in FIG. 6. Tool 10 thereafter rolls on the other wheel 22 and rotates around a point p at the tip of pin 52 as is illustrated in FIG. 7.

Thus, on a sloping street, it is possible to lift cover 11 and pivot it completely out of the way of the manhole in a manner that avoids the risk of loss of control of tool 10 from rolling on its wheels or the hazards of escape of cover 11. Furthermore, cover 11 is retained in a position for easy replacement which is accomplished by reverse direction pivoting around pin 52.

Note that securing of pin 52 in the other end of frame 51 can accommodate pivoting of tool 10 around the other end with wheel 22 raised from the ground. Alternatively, configuring attachment 50 in a "T" shape by location of pin 52 centrally in frame 51 can accommodate selective pivoting at either end. Other means for storage of attachment 50 are likewise possible, such as by a bracket on handle 25.

In practice, a fully satisfactory tool 10 was constructed from 0.5 inch steel for members 15 and 16, and 0.25-inch steel for wings 19 and 20, as well as for plate 18 which extended outwardly on about a six inch radius. A fourteen inch length of two inch square box channel formed frame 12 with three inch diameter hard rubber for caster wheels 21 and 22. An opening of 1.125 inches between the gripper plates of 18 and 29/30 handled most common sized manhole covers. Ramp 28 converged to the lower surface of plate 18 from about a 0.5 inch height at the rear and was formed as a crowned ridge as seen in FIG. 2. Pads 29 and 30 were about 0.5 inch square by about 0.25 inches high and partially rounded at the edges. Handle 25 was about six-feet in length.

FIG. 8 shows another embodiment of the invention in the form of tool 55 for handling an open grid grate 56 shown in phantom. Somewhat like the FIG. 1 embodiment, an elongated column 58 (shown broken in FIG. 8 to reduce its length) is attached to tool 55 and includes a T-handle 57 in the upper end to facilitate manual gripping and pivoting of tool 55. Column 58 is attached at the bottom to a gripper assembly formed by tubular frame member 59 of a square cross-section, plate member 60, J-shaped arms 61 and 62 and wheels 63 and 64. Plate 60 has a nub 65 extending downward therefrom and arms 61 and 62 have upwardly facing nubs 66 and 67. Thus, the spaced, triple pressure point engagement of grate 56 is similar to its counterparts in tool 10 in secure retention of grate 56. Note that nub 65 is in an offset relation to nubs 66/67 in contrast to the overlying relation of the FIG. 1 nubs.

As seen in FIGS. 10 and 11, plate 60 extends from frame 59 at a slight downward angle (about 12° in one model as constructed). In addition, plate 60 extends under frame member 59 by an amount sufficient to protrude beyond the outer periphery of grate 56. This allows the edge of plate 60 to dig in after arms 61 and 62 are inserted into the open grid of grate 56 and a backward rotational force is applied to lever column 58. As a result, grate 56 is initially pried upwards from lip 70 as shown in FIG. 11 breaking it loose of any dirt, ice or other matter tending to seal grate 56 in place. As column 58 is further pivoted rearward, grate 56 thereafter pivots upward. Eventually wheels 63 and 64 engage the ground and allow removal of the securely gripped grate 56.

Note that box-like member 59 is shown open at both ends and is especially suited for use with pivot pin attachment 50 as in the embodiment of FIG. 1. This can prevent rolling of tool 55 into the opening after grate 56 is removed especially in the presence of a slope of the surface around grate 56 towards the opening. Attachment 50 is also reversible for storage within member 59 if it is desired to have both wheels 63 and 64 engage the ground.

In FIG. 12, the plate handling tool 80 is configured similar to the FIG. 1 embodiment with plate 81 generally corresponding to plate 18 of FIG. 1 and a pair of downwardly projecting; J-shaped arms (only 82 is visible in FIG. 12) corresponding to arms 15 and 16. Box frame member 84 and wheels 85 complete a gripper assembly usable in substantially the same manner as the FIG. 1 apparatus whenever attachment 86 is in a position other than that shown in FIG. 12. Attachment 86 is constructed with a collar 87 which has a rod 88 rigidly attached thereto in downwardly extending relation as shown. Collar 87 is slidable along handle 90 and is secured in a selected location by a mechanism 89 as by a locking screw, pin or the like. The attachment 86 is primarily intended for use in conjunction with plate 95 which is a grate or manhole cover that has a hole 96 extending therethrough. Rod 88 is of a cross-section suitable for passing through hole 96 when collar 86 is secured in its lower position as shown in FIG. 12. By pulling backward on handle 90, the edge of the lower surface of plate 95 engages rod 88 while the upper surface of plate 95 is engaged by either the bottom of arms 82 or the right edge of rod 88 as seen in FIG. 12. Thus, tool 80 is functional with only rod 88, frame member 84 and wheels 85. However, it is preferable that arms 82 engage the upper plate 95 surface and include downward extending nubs or tips 83 to establish spaced pressure contact points to stabilize plate 95 from slipping laterally as cover 95 is maneuvered. Pivoting until wheels 85 are on the ground allows maneuvering substantially as described for the other embodiments.

Note that by making rod 88 adjustable or replaceable with differently oriented rods, it is possible to accommodate plates like 95 having different sized holes 96 and/or holes displaced from the peripheral edge of plate 95 by different distances. Note also that securing of attachment 86 at a location further up handle 90 permits use of tool 80 in the substantially same manner as the FIG. 1 embodiment. In addition, rod 88 of attachment 86 when secured further up handle 90 provides a convenient carrying handle for tool 80 especially if attachment 86 is secured in proximity to the center of gravity for tool 80 with handle 90 horizontal. Use of tool 80 with a pivot pin assembly 50 is also possible.

Tool 80 is used by orienting it vertically and inserting rod 88 so it extends through hole 96. Handle 90 is then rotated so that either the upper and lower surface edges of plate 95 engage rod 88, the lower surface engages rod 88 with the upper surface engaging the bottoms of arms 82, or both. Continued rotation of handle 90 brings wheels 85 into surface engagement to facilitate movement of the thus lifted plate 95.

Although the foregoing describes the exemplary preferred embodiments in relatively specific detail, those having normal skill in the art will recognize various changes, modifications, additions and applications other than those specifically mentioned herein without departing from the spirit of this invention.

What is claimed is:

1. Apparatus for facilitating the entire support and handling of heavy objects having generally flat, parallel and spaced opposite surfaces such as manhole covers, storm drain grates and the like comprising:

a gripper assembly including first and second plate means and an elongated frame means with said first and second plate means rigidly attached to said frame means and extending outwardly therefrom in spaced and substantially parallel relation with respect to one another so as to accept a heavy object inserted therebetween with the center of gravity of the object being disposed outward from said first and second plate means;

said first plate means including means for engaging one of the object surfaces in at least one pressure point adjacent an edge of an object when the object is inserted between said first and second plate means;

said second plate means including means for engaging the other of the object surfaces adjacent the edge of the object and in at least two pressure points when the object is inserted between said first and second plate means wherein said two pressure points are established in laterally spaced relation on opposite sides of said first plate means pressure point;

means for pivoting said gripper assembly in a direction generally perpendicular to at least one of the surfaces of the object when it is positioned between said first and second plate means, said pivoting of said gripper assembly thereby causing the object to be wedged between said pressure points by virtue of the relative positions of the object center of gravity and said pressure points; and roller means attached to said gripper assembly for permitting movement of said apparatus into a position for receiving the object between said pressure points and for subsequently transporting said apparatus after said gripper assembly is pivoted in an upward direction relative to the plane of at least one of the object surfaces.

2. Apparatus in accordance with claim 1 wherein said first plate means overlies the upper one of the object surfaces when the object is inserted between said first and second plate means; and said surface engaging means includes a ramp means sloping outwardly from said frame means whereby the object encounters a gradually reducing space between said first and second plate means as the object is introduced between said first and second plate means.

3. Apparatus in accordance with claim 1 wherein said pivoting means is a lever arm rigidly attached to said gripper assembly and extending in a direction generally perpendicular to the parallel planes of said first and second plate means; and said roller means includes first and second wheels each attached to respective ends of said elongated frame means and extending therefrom in a direction generally opposite said lever arm in generally surrounding relation to said two second plate means pressure points.

4. Apparatus in accordance with claim 1 wherein said roller means includes:

a wheel attached to one extremity of said elongated frame means; and stub means attached to the other extremity of said elongated frame means, said wheel and said stub means being positioned for accommodating arcuate movement of said gripper assembly around said stub means when said apparatus is pivoted to raise the object retained between said pressure points.

5. Apparatus in accordance with claim 4 wherein said roller means includes a second wheel attached to said elongated frame means at the same extremity as said stub means, said stub means and said second wheel being positioned so that said second wheel supports said other elongated frame means extremity when said apparatus is positioned for receiving the object whereas said stub means supports said other elongated frame means extremity when said apparatus is pivoted to raise the object.

6. Apparatus in accordance with claim 5 wherein said stub means is selectively positionable between an operable position as defined in claim 5 and an inoperable position wherein said second wheel supports said other elongated frame means extremity when said apparatus is pivoted to raise the object.

7. Apparatus in accordance with claim 1 particularly adapted for use in handling open grid grates wherein said first plate means extends under said elongated frame means for engaging the upper surface of the grate, and a pair of arms extending generally perpendicular to said first plate means and have said second plate means extending outward therefrom for engaging the lower surface of the grate in a direction opposite said first plate means.

8. Apparatus in accordance with claim 7 wherein said first plate means is of a length to extend beyond the grate periphery when said apparatus has received the grate between said first and second plate means for levering the grate upward at the side thereof engaged by said gripper assembly when said gripper assembly is pivoted.

* * * * *

UNITED STATES PATENT AND TRADEMARK OFFICE

CERTIFICATE OF CORRECTION

PATENT NO. : 4,852,855

DATED : August 1, 1989

INVENTOR(S) : Gerald L. Moisan

It is certified that error appears in the above-identified patent and that said Letters Patent is hereby corrected as shown below:

Column 1, line 29, after "bar" insert --is used to initiate lifting with the final removal--.

Signed and Sealed this

Twenty-first Day of July, 1992

*Attest:*

DOUGLAS B. COMER

*Attesting Officer*

*Acting Commissioner of Patents and Trademarks*